United States Patent [19]

Rogers, Jr. et al.

[11] Patent Number: 5,048,877

[45] Date of Patent: Sep. 17, 1991

[54] POP-UP HOOD LATCH

[75] Inventors: Lloyd W. Rogers, Jr.; Michael E. Aubry, both of Utica, Mich.

[73] Assignee: General Motors Corporation, Detroit, Mich.

[21] Appl. No.: 504,208

[22] Filed: Apr. 4, 1990

[51] Int. Cl.[5] ..... E05C 3/24

[52] U.S. Cl. ..... 292/110; 292/DIG. 14; 292/216

[58] Field of Search ..... 292/110, 109, 125, DIG. 14, 292/DIG. 43, DIG. 25, 225; 70/240

[56] References Cited

U.S. PATENT DOCUMENTS

| | | | |
|---|---|---|---|
| 2,268,741 | 1/1942 | Dall | 292/DIG. 14 |
| 2,507,196 | 5/1950 | Dall | 292/DIG. 14 |
| 2,658,779 | 11/1953 | Dall | 292/DIG. 14 |
| 2,924,473 | 2/1960 | Krause | 292/DIG. 14 |
| 3,378,291 | 4/1968 | Brian | 292/68 |
| 3,695,659 | 10/1972 | Gionet et al. | 292/216 |
| 3,905,624 | 9/1975 | Fujita | 292/11 |
| 4,045,064 | 8/1977 | Okada | 292/DIG. 27 |
| 4,875,724 | 10/1989 | Gruber | 292/DIG. 14 |
| 4,917,420 | 4/1990 | Rogers, Jr. | 292/DIG. 14 |
| 4,936,611 | 6/1990 | Palvölgyi | 292/216 |
| 4,961,601 | 10/1990 | Lindholm et al. | 292/216 |

FOREIGN PATENT DOCUMENTS

| | | | |
|---|---|---|---|
| 491723 | 9/1938 | United Kingdom | 292/110 |

*Primary Examiner*—Eric K. Nicholson

*Attorney, Agent, or Firm*—Raymond I. Bruttomesso, Jr.

[57] ABSTRACT

A hood latch engages a striker for latching a hood panel movable between open and closed positions relative to a body panel. The striker is mounted on one of the panels. A housing is mounted on the other panel. A pop-up lever is pivotally mounted to the housing for movement between lowered and raised positions. A pop-up spring bias the pop-up lever to the raised position. A latch lever has a hook for latching engagement with the striker. The latch lever is pivotally mounted to the pop-up lever for movement between latched and unlatched positions and has a handle for manually moving the latch lever. A latch spring acts between the pop-up lever and the latch lever to rotate the latch lever towards the latched position. A detent lever pivotally mounts to the housing for releasably engaging and retaining the pop-up lever in the lowered position and preventing rotation to the raised position. A detent spring acts between the detent lever and the housing for biasing rotation of the detent lever towards engagement with the pop-up lever. A cable is attached to the detent lever to rotate the detent lever away from engagement with the pop-up lever to release the pop-up lever from the lowered position. This release of the pop-up lever from the lowered position allows the pop-up spring to rotate the pop-up lever to the raised position. The latch lever and handle are then exposed to allow rotation of the handle.

3 Claims, 2 Drawing Sheets

POP-UP HOOD LATCH

The invention relates to a hood latch and more particularly a single latch hook mounted on a pop-up mechanism moving the latch hook between a lowered position latching the hood in the closed position and a raised position in which a handle carried by the latch hook is accessible to permit disengagement of the latch hook from the striker.

BACKGROUND OF THE INVENTION

It is known to latch a vehicle hood in the closed position by primary latch which is releasable to permit opening movement. Such a latch typically includes a latch bolt which engages a striker. The latch bolt is preferably mounted on the vehicle body and may be operated from inside the vehicle by a cable to release the latch.

It is also known to provide a secondary latch acting between the hood and the vehicle body to limit the opening movement of the hood after the primary latch is released. This secondary latch is released by a manually operated handle.

It is known to combine the primary and secondary latches into a single housing and to have the primary fork bolt and the secondary latch hook both engage with a single striker.

It would be desirable to provide a hood latch in which a single latch bolt or latch hook would engage with a single striker, and yet provide both a remotely releasable primary latching function and a manually releasable secondary latching function.

SUMMARY OF THE INVENTION

This invention provides a hood latch adapted to engage a striker for latching a hood panel movable between open and closed positions relative to a body panel. The striker is mounted on one of the panels. A housing is mounted on the other panel. A pop-up lever is pivotally mounted to the housing for movement between lowered and raised positions. A pop-up spring biases the pop-up lever to the raised position. A latch lever has a hook for latching engagement with the striker. The latch lever is pivotally mounted to the pop-up lever for movement between latched and unlatched positions and has a handle for manually moving the latch lever. A latch spring acts between the pop-up lever and the latch lever to rotate the latch lever towards the latched position. A detent lever pivotally mounts to the housing for releasably engaging and retaining the pop-up lever in the lowered position and preventing rotation to the raised position. A detent spring acts between the detent lever and the housing for biasing rotation of the detent lever towards engagement with the pop-up lever. A cable is attached to the detent lever to rotate the detent lever away from engagement with the pop-up lever to release the pop-up lever from the lowered position. This release of the pop-up lever from the lowered position allows the pop-up spring to rotate the pop-up lever to the raised position, by which the hood panel is moved upwardly in relation to the body panel. The latch lever and handle are exposed to allow rotation of the handle to release the latch lever from the striker allowing the hood panel to move to the open position relative to the body panel.

One object, feature and advantage of the invention is a single latch hook mounted on a pop-up mechanism moving the latch hook between a lowered position latching the hood in the closed position and a raised position in which a handle carried by the latch hook is accessible to permit disengagement of the latch hook from the strike.

Another object, feature and advantage of the invention resides in a hood latch in which a single latch hook engages with a single striker, and yet provides both a remotely releasable primary latching function and a manually releasably secondary latching function.

Another object, feature and advantage of the invention resides in a single latch hook engaging a single striker facilitating the combining of the pop-up spring, the primary latch function and the secondary latch function in one unit that can be assembled to the vehicle.

Further objects, features and advantages of the present invention will become more apparent to those skilled in the art as the nature of the invention is better understood from the accompanying drawings and detailed description.

DESCRIPTION OF THE PREFERRED EMBODIMENT

Figure 1:
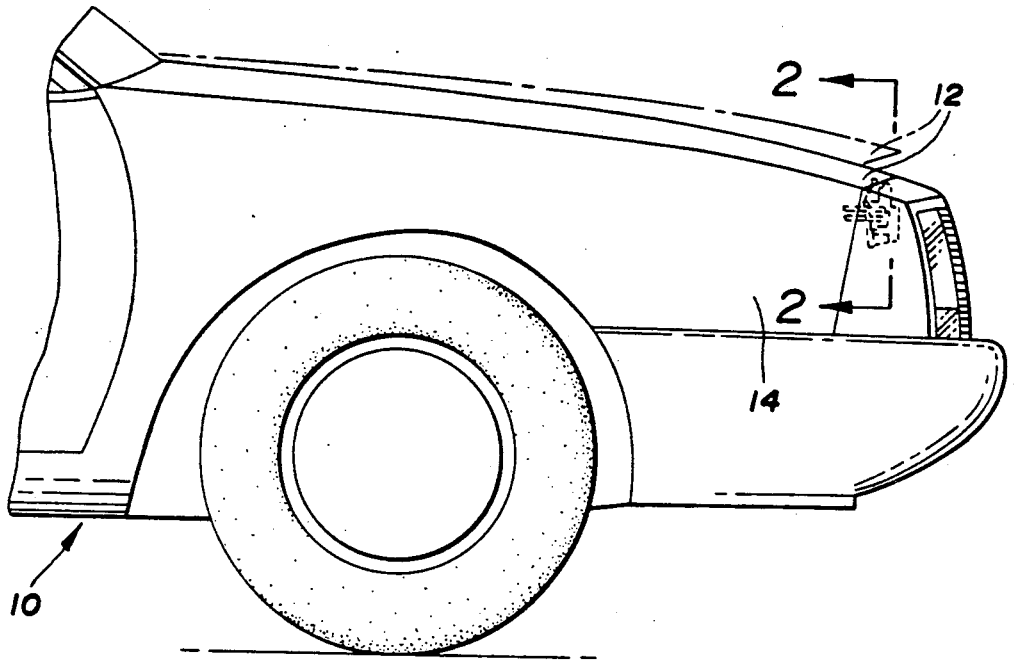
FIG. 1 is a side elevation of the front portion of the motor vehicle showing the location of the striker and the housing.
Figure 2:
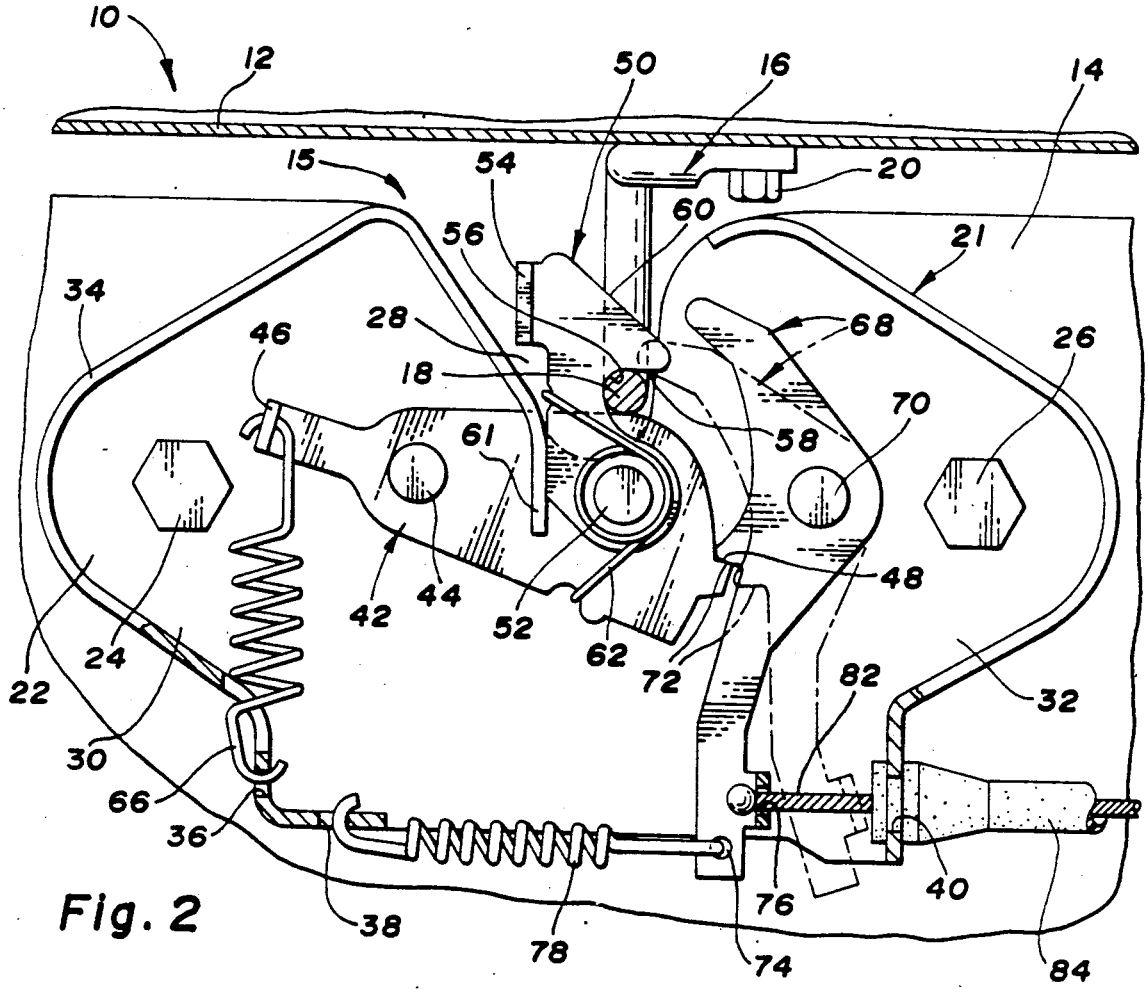
FIG. 2 is a elevation view of the latch in the latched position. The detent lever in the released position is shown in phantom.

A motor vehicle 10 has a hood panel 12 as shown in FIG. 1, which is hingedly connected to a body panel 14 for movement between and open and closed positions relative to the body panel 14. FIG. 2 shows a latch mechanism 15 comprised of a striker 16 and a latch 21 that hold the hood panel in the closed position. The striker 16 has a loop 18 and is attached to the hood panel 12 with a bolt 20 as seen best in FIG. 3.

The latch 21 has a housing 22 having a pop-up lever 42, a latch lever 50 and a detent lever 68. The housing 22 is connected to the body panel 14 by a pair of bolts 24 and 26 as shown in FIG. 2. A bight 28 is formed in the housing 22 to received the loop 18 of the striker 16 and divides the housing into a first end 30 and a second end 32. A flange 34 is formed around the outer portion of the housing 22 and the bight 28 for stiffening the housing 22. Three holes 36, 38 and 40 are located in the flange 34 for mounting of other elements as described below.

Figure 3:
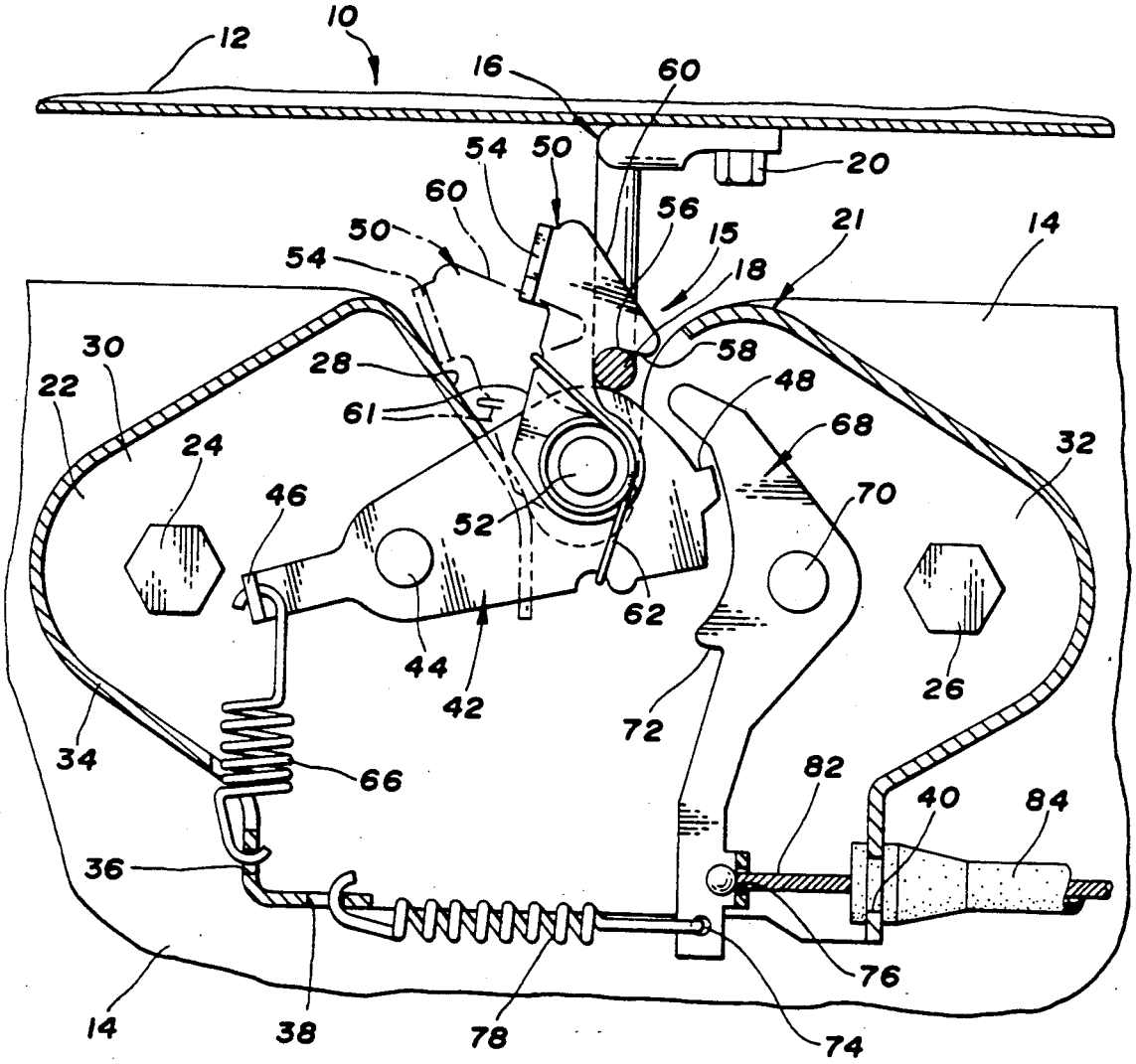
FIG. 3 is a elevation view of the pop-up latch in the raised position and the latch lever. The latch lever in the unlatched position is shown in phantom.

The pop-up lever 42 is pivotally attached to the first end 30 of the housing 22 by a first pivot bushing 44 for rotation between a lowered position shown in FIG. 2 and a raised position shown in FIG. 3. The pop-up lever 42 has a tab 46 on one side of the pivot bushing 44 and a stop 48 formed on the other side of the pivot bushing 44.

The latch lever 50 is pivotally attached to the pop-up lever 42 by a second pivot bushing 52 for movement between the latched and the unlatched position. The second pivot bushing 52 is mounted on the latch lever 50 on the stop 48 side of the first pivot bushing 44. The latch lever 50 has a tab 54, and a cut out area 56 that forms a hook 58 located vertically above the second pivot bushing 52. The top of the latch lever 50 has an angled surface 60 for contact with the loop 18 of the striker 16 as the hood panel 12 is lowered as further described below. A back edge 61 of the latch lever 50 is located below the tab 54 and engages with the flange 34 of the housing 22 when the pop-up lever 42 is in the lowered position to prevent pivotal rotation of the latch lever 50 in a counterclockwise direction.

A latch spring 62 surrounds the second pivot bushing 52 and has one end connected to the latch lever 50 and another end connected to the pop-up lever 42. The spring 62 biases the latch lever 50 in a clockwise direction, to rotate the hook 58 to the latched position shown in FIG. 3.

A pop-up spring 66 is connected between the tab 46 on the pop-up lever 42 and the first hole 36 in the flange 34 of the housing 22 and biases the pop-up lever 42 counterclockwise to the raised position which raises the latch lever 50 vertically as seen in FIG. 3.

The detent lever 68 is attached to the second end 32 of the housing 22 by a third pivot bushing 70 for movement between an engaged position as shown in FIG. 2 and a released position as shown in phantom in FIG. 2. The detent lever 68 has a tab 72 and two attachment holes 74 and 76, all vertically below the pivot bushing 70. The tab 72 engages with the stop 48 of the pop-up lever 42 to retain the pop-up lever 42 in the lowered position as shown in FIG. 2.

A detent spring 78 is connected between the first attachment hole 74 on the detent lever 68 and the second hole 38 in the flange 34 of the housing 22. The detent spring 78 biases the detent lever 68 to the engaged position which retains the tab 72 of the detent lever 68 in engagement with the stop 48 of the pop-up lever 42.

A cable 82 is attached to the detent lever 68 at the second attachment hole 76. The cable 82 is threaded through a cable release attachment 84 which is mounted to the flange 34 of the housing 22 at the third hole 40.

FIG. 2 shows the hood panel 12 closed and latch. To release the striker 16 from the latch 21, a cable release lever is activated inside of the vehicle, not shown. Cable 82 pivots the detent lever 68 counterclockwise and moves the tab 72, which has been mated with the stop 48 on the pop-up lever 42, from the engaged position to the released position shown in phantom in FIG. 2. The uncoupling of the tab 72 on the detent lever 68 from the stop 48 on the pop-up lever 42 permits the pop-up lever 42 to pivot in the counterclockwise direction to the raised position shown in FIG. 3 due to the bias provided by the pop-up spring 66. The detent lever 68 is returned to the position shown in FIG. 3 by the detent spring 78 as soon as the cable release lever is released and the pop-up lever 42 has rotated.

As the pop-up lever 42 rotates upward, the latch lever 50 and the striker 16 are pushed up into the secondary latch position shown in FIG. 3. In this position, the hook 58 of the latch lever 50 remains hooked over the loop 18 of the striker 16. To unlatch the latch lever 50, the tab 54 on the latch lever 50 is rotated counterclockwise, until the latch lever 50 is in the unlatched position as shown in phantom in FIG. 3. Then the striker 16 and the hood panel 12 are clear of the latch lever 55 and the housing 22, and can be lifted to a completely open position.

When the hood panel 12 is lowered, the striker 16 will travel downward until the loop 18 contacts the angled surface 60 of the latch lever 50. This causes the striker 16 to cam the latch lever 50 in a counterclockwise direction thus forcing the latch lever 50 out of the path of the loop 18 of the striker 16. When the loop 18 has traveled down the angled surface 60 and into the hook 58 of the latch lever 50, the latch lever 50 is able to spring back to the latched position thus hooking the loop 18 of the striker 16. The striker 16 is now in contact with the pop-up lever 42. Further downward motion of the striker 16 cause the pop-up lever 42 to be pivoted about the first pivot bushing 44 in a clockwise direction. The back edge 61 of the latch lever 50 makes contact with the flange 34 of the housing 22 as this downward movement continues, disabling the pivotal movement of the latch lever 50. The rotation of the pop-up lever 42 causes the stop 48 to force the detent lever 68 to pivot slightly in a counterclockwise direction until the stop 48 clears the tab 72 of the detent lever 68. The bias of the detent spring 78 forces the tab 72 of the detent lever 68 to mate against the stop 48 of the pop-up lever 42, thus setting the pop-up lever 42 in the lowered position. The latch mechanism 15 thus retains the hood panel 12 in the closed position.

While one embodiment of the present invention has been explained, various modifications within the spirit and scope of the following claims will be readily apparent to those skilled in the art.

The embodiments of the invention in which an exclusive property or privilege is claimed are defined as follows:

1. A hood latch adapted to engage a striker for latching a hood panel movable between open and closed positions relative to a body panel, the hood latch comprising:

the striker mounted on one of the panels;

a housing mounted on the other the panel;

a latch lever mounting means movably mounted to the housing for movement between lowered and raised positions;

a pop-up spring for urging the latch lever mounting means to the raised position;

a latch lever having a hook for latching engagement with the striker, the latch lever being pivotally mounted to the latch lever mounting means for movement between latched and unlatched positions, the latch lever having a handle for manually moving the latch lever;

a latch spring acting to rotate the latch lever towards the latched position;

a detent means for releasably engaging and retaining the latch lever mounting means in the lowered position and preventing movement to the raised position; and means for moving the detent means to release the latch lever mounting means from the lowered position, thereby allowing the pop-up spring to move the latch lever mounting means to the raised position, by which the hood panel is moved upwardly in relation to the body panel, to expose the latch lever and handle for rotation by the handle to release the latch lever from the striker allowing the hood panel to move to the open position relative to the body panel.

2. A hood latch adapted to engage a striker for latching a hood panel movable between open and closed positions relative to a body panel, the hood latch comprising:

the striker mounted on one of the panels;

a housing mounted on the other the panel;

a pop-up lever pivotally mounted to the housing for movement between lowered and raised positions;

a pop-up spring for urging the pop-up lever to the raised position;

a latch lever having a hook for latching engagement with the striker, the latch lever being pivotally mounted to the pop-up lever for movement between latched and unlatched positions, the latch lever having a handle for manually moving the latch lever;

a latch spring acting between the pop-up lever and the latch lever to rotate the latch lever towards the latched position;

a detent lever pivotally mounted to the housing for releasably engaging and retaining the pop-up lever in the lowered position and preventing rotation to the raised position; and means for rotating the detent lever to release the pop-up lever from the lowered position, thereby allowing the pop-up spring to rotate the pop-up lever to the raised position, by which the hood panel is moved upwardly in relation to the body panel, to expose the latch lever and handle for rotation by the handle to release the latch lever from the striker allowing the hood panel to move to the open position relative to the body panel.

3. A hood latch adapted to engage a striker for latching a hood panel movable between open and closed positions relative to a body panel, the hood latch comprising:

the striker mounted on one of the panels;

a housing mounted on the other the panel, the housing having a bight demarcating a first end and a second end;

a pop-up lever pivotally mounted to the first end of the housing for movement between lowered and raised position;

a pop-up spring mounted between the pop-up lever and the housing for urging the pop-up lever to the raised position;

a latch lever having a hook for latching engagement with the striker, the latch lever being pivotally mounted to the pop-up lever for movement between latched and unlatched positions, the latch lever having a handle for manually moving the latch lever to the unlatched position;

a latch spring acting between the pop-up lever and the latch lever to rotate the latch lever towards the latched position;

a detent lever pivotally mounted to the second end of the housing for releasably engaging and retaining the pop-up lever in the lowered position and preventing rotation to the raised position;

a detent spring attached between the detent lever and the housing for biasing the rotation of the detent lever towards engagement with the pop-up lever; and a cable attached to the detent lever to rotate the detent lever away from engagement with the pop-up lever to release the pop-up lever from the lowered position, thereby allowing the pop-up spring to rotate the pop-up lever to the raised position, by which the hood panel is moved upwardly in relation to the body panel, to expose the latch lever and handle for rotation by the handle to release the latch lever from the striker allowing the hood panel to move to the open position relative to the body panel.

* * * * *